United States Patent [19]

Phillips et al.

[11] Patent Number: 5,005,719

[45] Date of Patent: Apr. 9, 1991

[54] TAMPER EVIDENT OPTICAL DEVICE AND ARTICLE UTILIZING THE SAME

[75] Inventors: Roger W. Phillips; Vernon C. Spellman; Wayne L. Gossett; Marc A. Kamerling; Paul G. Coombs; David W. Todd; Steven A. Silver, all of Santa Rosa, Calif.

[73] Assignee: Flex Products, Inc., Santa Rosa, Calif.

[21] Appl. No.: 368,200

[22] Filed: Jun. 19, 1989

Related U.S. Application Data

[63] Continuation-in-part of Ser. No. 147,891, Jan. 25, 1988, Pat. No. 4,840,281, which is a continuation-in-part of Ser. No. 894,320, Aug. 7, 1986, Pat. No. 4,721,217.

[51] Int. Cl.[5] ..... B65D 55/02

[52] U.S. Cl. ..... 215/230; 206/459; 229/102; 350/166

[58] Field of Search ..... 215/230, 365, 366; 229/102; 206/459, 807; 350/166

[56] References Cited

U.S. PATENT DOCUMENTS

| | | | |
|---|---|---|---|
| 3,858,977 | 1/1975 | Baird et al. | 350/166 |
| 4,475,661 | 10/1984 | Griffen | 215/366 |
| 4,480,749 | 11/1984 | Laucis et al. | 206/459 |

*Primary Examiner*—Lowrance George E.
*Attorney, Agent, or Firm*—Flehr, Hohbach, Test, Albritton & Herbert

[57] ABSTRACT

Tamper evident optical device comprising a substrate and a multi-layer taper evident splittable coating carried by the substrate. The coating has a release region formed therein. An adhesive is secured to the tamper evident coating.

25 Claims, 7 Drawing Sheets

TAMPER EVIDENT OPTICAL DEVICE AND ARTICLE UTILIZING THE SAME

This application is a continuation-in-part of a Ser. No. 147,891, filed Jan. 25, 1988, now U.S. Pat. No. 4,840,281, continuation-in-part of Ser. No. 894,320 filed Aug. 7, 1986, now U.S. Pat. No. 4,721,217.

This invention relates to a tamper evident optical device and to an article utilizing the same.

Because of tampering with certain consumer-type products, there has been an attempt to make such products more tamper proof, or in other words, tamper resistant. Even though many changes have been made to make consumer type products more tamper resistant, the tamper resistant packaging provided still can be violated. In view of the fact that making packaging more tamper proof is expensive and often makes the consumer type products more difficult to utilize by the consumer, there is a need for a different approach to attempt to solve the problems. Thus for example, rather than attempting to make the consumer type products more tamper resistant, an alternative approach which may be preferable is to make the package in such a way so that if tampering occurs it will be evident to the consumer at the point of sale. There is therefore a need for a device which can be utilized on articles such as packages and containers which will make it apparent to the consumer at the point of sale if tampering has occurred.

In general, it is an object of the invention to provide an optical device which can be utilized with packaging to indicate to the consumer when tampering has occurred.

Another object of the invention is to provide an optical device of the above character which can be utilized in conjunction with containers.

Another object of the invention is to provide an optical device of the above character which can be incorporated into packaging utilizing conventional packaging equipment.

Another object of the invention is to provide an optical device of the above character which is an optically variable device.

Another object of the invention is to provide an optical device which changes appearance when separated into two parts.

Another object of the invention is to provide an optical device of the above character in which a release layer is provided between the layers and wherein the separation occurs in or adjacent to the release layer.

Another object of the invention is to provide an optical device of the above character which changes color when separated into two parts.

Another object of the invention is to provide an optical device of the above character which does not shift color with a change in angle.

Another object of the invention is to provide an optical device of the above character which has a dark appearance before separation and a light appearance after separation.

Another object of the invention is to provide an optical device of the above character which can carry an imprint within the same.

Another object of the invention is to provide an optical device of the above character in which the imprint can be colored.

Another object of the invention is to provide an optical device of the above character in which there is a color shift with angle change.

Another object of the invention is to provide an optical device of the above character in which certain optical properties are destroyed when the integrity of the packaging has been violated.

Another object of the invention is to provide an optical device of the above character which is easy to manufacture.

Another object of the invention is to provide an optical device of the above character which can be made in a single vacuum that is, there is no need to break vacuum during the making of the device.

Another object of the invention is to provide an optical device of the above character which can be made in a single vacuum.

Additional objects and features of the invention will appear from the description in which the preferred embodiments are set forth in detail in conjunction with the accompanying drawings.

In general, the tamper evident optical device includes a substantially transparent substrate. A tamper evident splittable coating is carried by the substrate. The tamper evident coating has a release layer formed therein. Adhesive means is secured to the tamper evident coating. The adhesive means includes means which permits the device to be handled without adhering to other substances with which the device may come into contact.

The device can also include a liner that has a metal layer incorporated therein. The adhesive means secures the liner to the tamper evident coating and includes an induction adhesive secured to the liner. The tamper evident device can be incorporated into an article having first and second parts in which the induction adhesive is adherent to one of the parts.

The article which utilizes the tamper evident optical device has first and second parts which are movable with respect to each other. The tamper evident optical device has its first and second layers secured respectively to the first and second parts of the article so that when the first and second parts of the article move with respect to each other, the release layer permits the movement of the first and second layers with respect to each other to destroy certain of the optical properties of the optical device.

Figure 1:
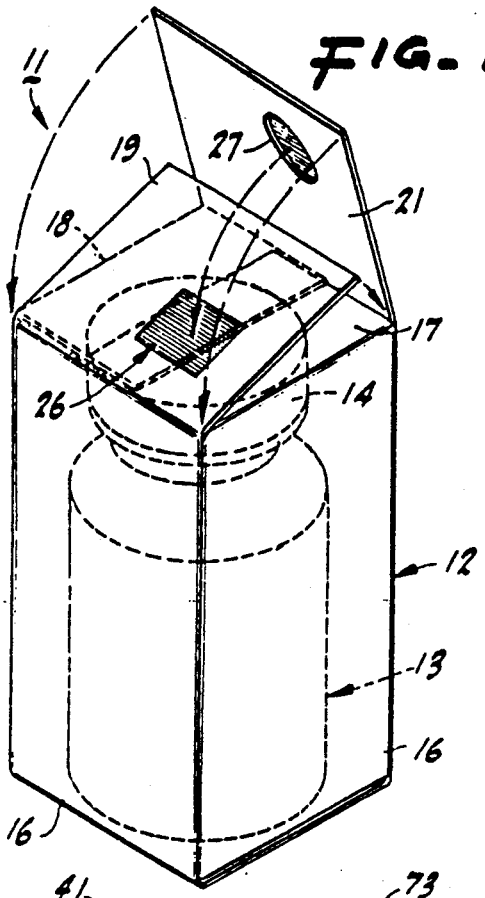
FIG. 1 is a perspective view of a package and container of the present invention incorporating a tamper evident optical device.

More particularly as shown in the drawings, the tamper evident optical device and the article utilizing the same as shown in FIG. 1 consists of a container package 11. The container package 11 consists of a box 12 which contains therein a bottle 13 having a cap 14 threadedly mounted thereon. The bottle 13 can be formed of any suitable material such as glass or plastic. Similarly, the cap 14 can also be formed of a suitable material such as metal or plastic. As shown the bottle 13 has a conventional cylindrical configuration. The box 12 also is of a conventional cardboard type and is of a generally rectangular configuration. The box is formed in a conventional manner and is provided with flaps for closing the ends. The box is provided with four side walls in which adjoining side walls extend at right angles to each other. Four flaps 17, 18, 19 and 21 are provided on each end of the box 12. Two of the flaps, as for example, 19 and 21 serve as first and second parts of the box and are movable with respect to each other.

Figure 2:
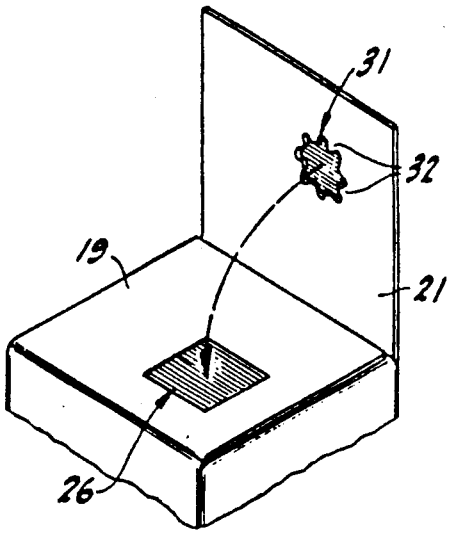
FIG. 2 is a perspective view of a package containing another embodiment of the present invention.

The tamper evident optical device 26 of a type hereinafter described is disposed between the flaps 19 and 21. An aperture window 27 is provided in the outer flap 21 to permit viewing of the optical device 26 to see whether or not it has angle shifting properties. As can be seen from Figure the window 27 has a circular configuration. Other configurations can be utilized if desired. For example as shown in FIG. 2, another type of window 31 has been provided which has serrations 32 formed in its margins which serve a purpose as hereinafter described.

Figure 3:
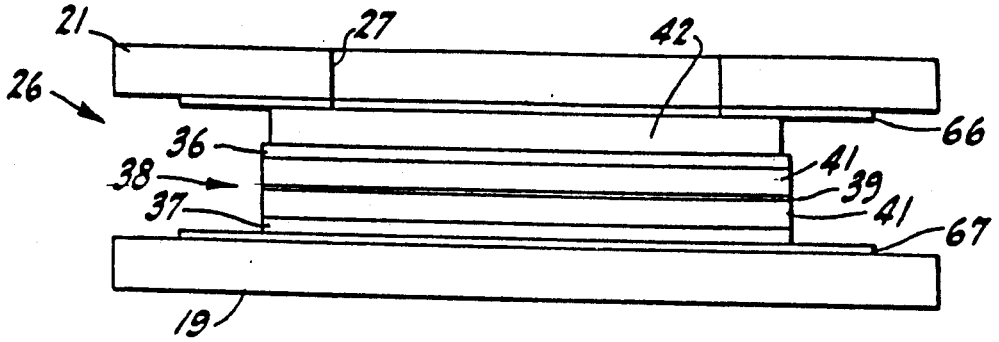
FIG. 3 is a cross-sectional view of a tamper evident optical device utilized on a container such as a bottle incorporating the present invention.

The tamper evident optical device 26 of the present invention can be of the type shown in FIG. 3. As shown therein, the tamper evident optical device 26 can be of the type described in co-pending application Ser. No. 630,414 filed on July 13, 1984, now U.S. Pat. No. 4,705,356. As described therein, it is comprised of at least first and second layers 36 and 37 which form part of a metal-dielectric-metal interference filter 38. A release layer 39 is disposed between first and second layers 36 and 37 and, as shown, is provided in a spacer layer 41. The layers 36, 37, 39 and 41 are formed upon and carried by a substrate 42 to provide the interference filter 38.

Figure 4:
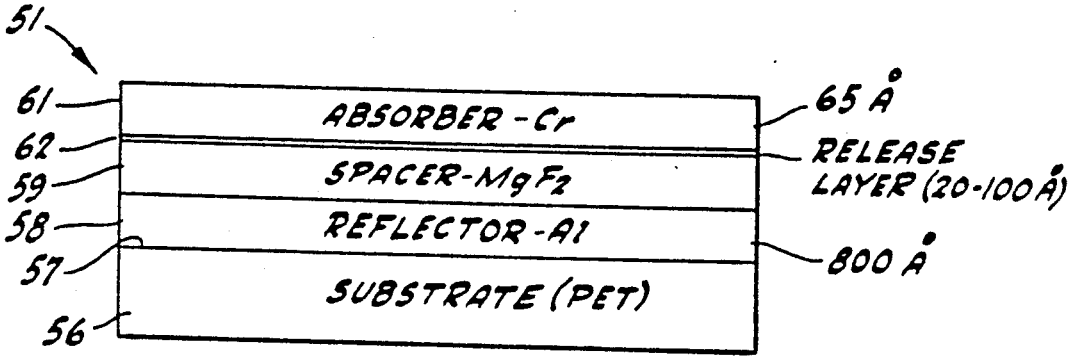
FIGS. 4, 5 and 6 are cross-sectional views of three different designs for tamper evident optical devices for use in a package.
Figure 5:
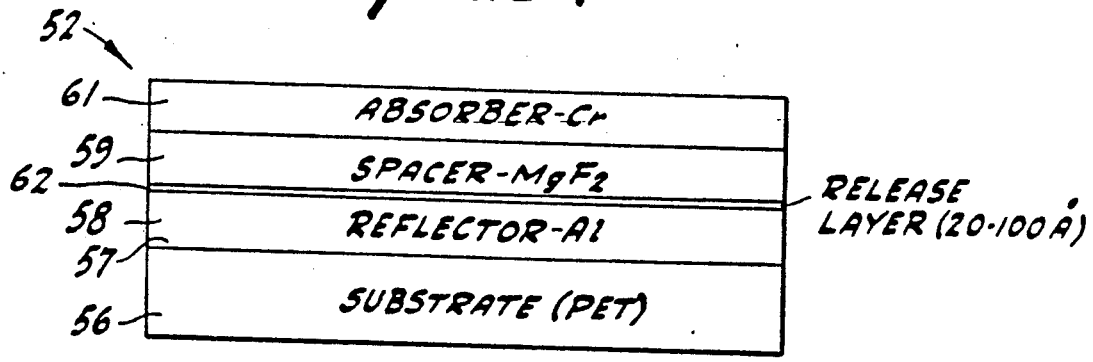
Figure 6:
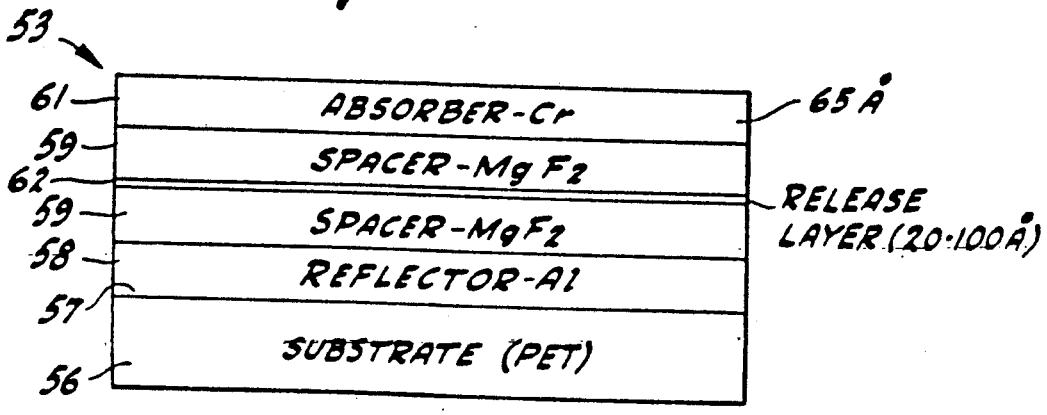

The release layer 39 is disposed between the absorber layer and the reflector layer. Three general designs of the tamper evident optically variable device of the present invention are shown in FIGS. 4, 5 and 6. Each of the designs consists of a substrate 56 which has at least one surface 57. The substrate 56 is formed of a suitable material of the type described in co-pending application Ser. No 630,414 filed on July 13, 1984, now U.S. Pat. No. 4,705,356. As described therein it can be formed of polyethylene terephthalate (PET). Typically the substrate 56 can be formed of material having a thickness ranging between 50 gauge and 700 gauge which would be approximately 0.00050 inches to 0.007 inches. The substrate material is preferably transparent. However, if desired it can be opaque. It also can be colored.

A reflector layer 58 is deposited on the surface 57 of the substrate 56. The reflector layer 58 is formed of a metal and is deposited to a thickness so that it is opaque. The metal utilized should preferably be a high reflector such as aluminum. Other metals can be utilized which have a whitish appearance and which have good reflection characteristics. For example, reflectors such as nickel and silver (if stabilized) could be used. In addition, other materials such as commonly known grey metals can be utilized if their lower reflection characteristics can be tolerated. The metal utilized should be deposited to a thickness so it is opaque. If aluminum is used, this would be a thickness of approximately 600 Angstroms $\pm 20\%$.

A dielectric spacer layer 59 is deposited on the metal reflector layer 58. In order to obtain as rapid a color shift as possible, it is desirable that the spacer layer be formed of a material having a very low index of refraction. For that reason, the layer is formed of a dielectric having an index of refraction of $n=1.9$ or below. Materials meeting this criteria are inorganic materials like magnesium fluoride, $n=1.38$; yttrium fluoride, $n=1.55$; silicon dioxide, $n=1.45$, etc. Organic materials such as TFE (tetrafluoroethylene, Teflon), $n=1.38$; FEP (fluorinated ethylene-propylene copolymer) $n=1.34$; polypropylene, $n=1.45$; polyethylene, $n=1.5$; polyethylene terephthate (PET, Mylar) $n=1.6$; or waxes, $n=$approximately 1.5 may be utilized. The spacer layer 59 is put down to a thickness ranging from between 3 and 7 quarter waves with a design wavelength in the visible spectrum that ranges from 400 to 700 microns. It has been found that if more than 7 quarter waves are utilized the color becomes muted or becomes white. If approximately less than 3 quarterwaves are utilized, there is insufficient color shift.

A metal absorber layer 61 is deposited on the spacer layer 59. The thickness of the spacer layer 59 determines which wavelengths will be absorbed by the absorber layer 61. Thus it can be seen that by changing a thickness of the spacer layer, different colors can be obtained for the color shift desired with the optically variable device. The absorber layer 61 is formed of a highly absorbing material such as a metal and is put on to a thickness so that it provides substantially zero reflection at the selected design wave length in the visible spectrum. The metal which is utilized in the absorber layer 61 can be any of the grey metals such as chromium, nickel, titanium, vanadium, cobalt and palladium. The use of such grey metals for the absorber layer 61 is desirable because the gray metals have high absorption values. A grey metal can be characterized as a metal having high absorption where the n and k are nearly equal and the ratio of k over n is small as, for example, in the range of 1:2. When the grey metal is placed on the spacer layer to provide a minimum of reflection at the selected design wavelength in the visible spectrum, it has a thickness which is in the vicinity of 100 Angstroms or less. For example, if the absorber layer is formed of chromium, it can have a thickness of approximately 65 Angstroms ±10%.

In the optically variable devices shown in FIGS. 4, 5 and 6, it can be seen that a metal dielectric metal or tri-layer system design has been provided in which the spacer layer serves the critical function providing the desired color shift. In each of the three designs, a release layer 62 has been incorporated, either in the spacer layer 59 itself or on opposite sides of the spacer layer 59. Thus as shown in FIG. 4, the release layer 62 has been provided between the absorber layer 61 and the spacer layer 59. In the design shown in FIG. 5, the release layer 62 has been provided between the spacer layer 59 and the reflector layer 58. In the third design shown in FIG. 6, the release layer 62 has been provided between the two separate portions of the spacer layer 59.

The release layer 62 is formed of a material having an index of refraction which is close as possible to the index of refraction of the spacer layer 59 so that it does not effect to a significant degree the optical properties of the optically variable device. The release layer 62 should be formed of a material which permits separation of the metal-dielectric-metal interference filter which comprises the optically variable device. One material found to be particularly satisfactory for this purpose is Teflon which is flashed onto the appropriate layer in the desired position as shown by any one of the three designs shown in FIGS. 4, 5 and 6 to a suitable thickness as for example, from 20 to 100 Angstroms. By providing such a release layer 62 it is possible to readily separate the absorber layer from the reflector layer and thus destroy the optically variable effects of the optically variable device to render the optically variable device nonfunctional. By separating the absorber layer from the reflector layer, the phase coherence of the interference filter is destroyed. Once this phase coherence has been destroyed, it is impossible to re-establish this phase coherence even if an attempt is made to reassemble the two separated parts. It has been found that once an optically variable device has been separated in a manner in which the absorber layer is separated from the reflector layer, the color shift characteristics have been destroyed. Even if it would be possible to restore some color shift characteristics, a different color shift or color resembling an oil slick would occur which would clearly disclose that the optically variable device had been tampered with. Attempts to re-establish the optically variable device by gluing together the two parts would result in failure because the glue itself would have some finite thickness which would make it impossible to restore the color shift characteristics so that a single color would still remain or, at best, a different color shift would be achieved.

The designs shown in FIGS. 4–6 can also be used in the reverse configuration on the substrate 56. In this instance, the color shift would be seen through the substrate 56 and would by necessity be optically transparent.

By way of example, optical devices incorporating the present invention with release layers therein have been provided in which color shifts have been achieved. One optically variable device had a green color in reflectance when viewed at normal incidence and at a viewing angle of approximately 45°, it had a blue color. After it was pulled apart all that could be seen on one side was an aluminum reflector and on the other side a grayish color in transmission and at an angle only a tinge of blue in reflection. Thus the optically variable device after it once had been separated by the use of the release layer and then placed together again would have a silvery color at all angles, i.e., no color change with angle, which would clearly indicate that the optically variable device had been separated. In other words, the optically variable device had its color shift capabilities destroyed clearly indicating tampering with the optically variable device.

The optical device 26 can be any one of the optically variable devices 51, 52 and 53 described in FIGS. 4, 5 and 6. As shown in FIG. 3, the optically variable device can be incorporated between the two flaps 19 and 21 of the cardboard carton or container 11. Suitable means is provided for securing the optically variable device to the flaps 19 and 21 and as shown in FIG. 3 can take the form of layers 66 and 67 of a suitable adhesive. The layer 66 secures the flap 21 to the substrate 42 and the adhesive layer 67 secures the flap 19 to the layer 37. After the optically variable device has been glued between the two flaps 19 and 21 by the use of the adhesive layers 66 and 67 and is positioned in such a manner so that it is visible through the opening 27, a color shift with angle can be ascertained. By way of example, at normal incidence, the optically variable device will have a green appearance and at an angle of approximately 45°, the optically variable device will have the color of blue.

When the outside flap 21 is opened, the optically variable device 26 will be separated at the release layer 39. As soon as the optically variable device has been separated, the angle shifting properties are destroyed. Thus it can be seen that if such an optically variable device were to be utilized on a package for a consumer type product, the consumer picking up the product from a store shelf could readily ascertain whether or not there had been any tampering with the product by viewing the optically variable device to ascertain whether or not a color shift occurs with change of viewing angle. If there is no color shift, then the consumer knows that the product has been tampered with and should not be purchased.

In the embodiment shown in FIG. 3 it can be seen that the reflector can be deposited on the substrate followed by the spacer layer and the absorber layer. In certain applications, it may be desirable to reverse this sequence by depositing the absorber layer on the substrate followed by the spacer layer and then depositing the reflector layer. When manufactured in this manner, the optically variable device can be mounted in the manner shown in FIG. 3 in which the substrate 42 faces the opening making it necessary to view the optically variable device through the polyester film which is utilized for the substrate. Such an arrangement is desirable because the polyester film inhibits cutting through the optically variable device and removing a portion of the optically variable device. Such cutting operations can be inhibited by the use of serrations 32 as shown in FIG. 2. By providing such serrations, it would be very difficult, if not impossible, to remove a portion of the optically variable device and affix it to another carton already tampered with without destroying the same. It should be appreciated that if desired, the optically variable device can be positioned in such a manner so that the substrate is positioned away from the opening 27.

Figure 9:
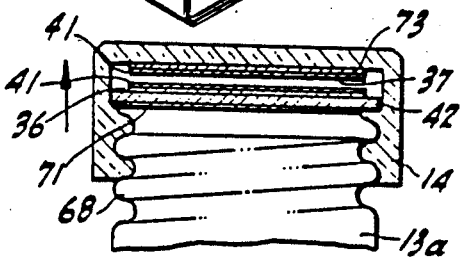
FIG. 9 is a cross-sectional view showing the manner in which the optical device incorporating the present invention can be destroyed.
Figure 8:
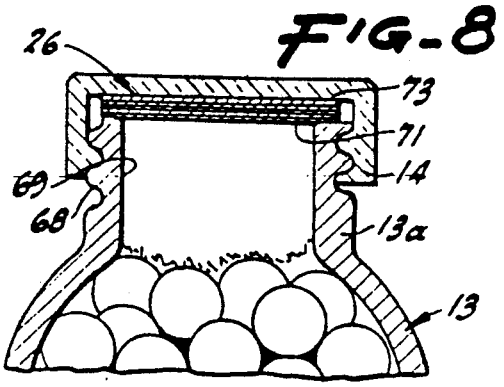
FIG. 8 is a cross-sectional view similar to FIG. 7 but showing a transparent cap mounted on the container.
Figure 7:
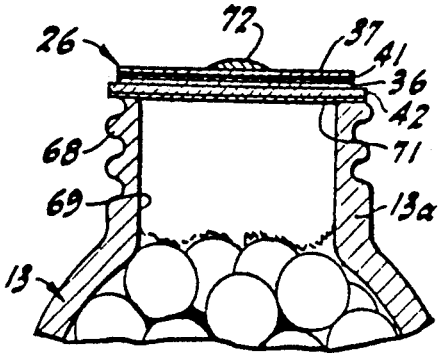
FIG. 7 is a partial cross-sectional view showing the upper portion of a container having an optical device mounted thereon.

Another embodiment of the invention is shown in which the tamper evident optically variable device is incorporated into the bottle itself rather than into the package containing the bottle. This embodiment is shown in FIGS. 7, 8 and 9. As shown therein, the bottle 13 is provided with a necked portion 13*a* which is provided With external threads 68 which are adapted to receive the cap 14 which encloses the opening 69 in the neck 13*a*. An optically variable device 26 of the type hereinbefore described is sized to fit over the top of the necked portion 13*a* and has one side of the same, as for example, the substrate side secured to the top of the necked portion 13*a* by suitable means such as an adhesive layer 71. After the optically variable device 26 has been applied to the top of the bottle 13, a clear adhesive 72 is applied to the top of the optically variable device 26 as shown in FIG. 7 and thereafter the cap 14 is screwed onto the necked portion 13*a* of the bottle 13 to spread out the glue 72 to form an adhesive layer 73 between the cap and the optically variable device 26. The cap 14 as shown is transparent so that the optically variable device 26 can be viewed through the adhesive and top of the cap. It should be appreciated, if desired, a portion of the cap can be formed so it is opaque with only a portion of the same being transparent so as to permit viewing of the optically variable device 26.

When the bottle 13 is opened by rotating the cap 14, the optically variable device 26 is destroyed because the adhesive layers 71 and 73 hold the optically variable device 26 to the top of the neck of the bottle 13*a* and the bottom inside of the cap 14 so that rotation of the cap 14 causes a shearing action to take place within the optically variable device 26 along the plane of the release layer provided within the spacer layer 41 to cause the optically variable device to separate as shown in FIG. 9 and to cause destruction of the angle shifting characteristics of the optically variable device. Thus again it can be seen that if the bottle has been tampered with, the optically variable device will be destroyed which will give a visible indication to the consumer that tampering has occurred because the angle shift properties causing the changes in color with viewing angle will no longer be present.

Figure 10:
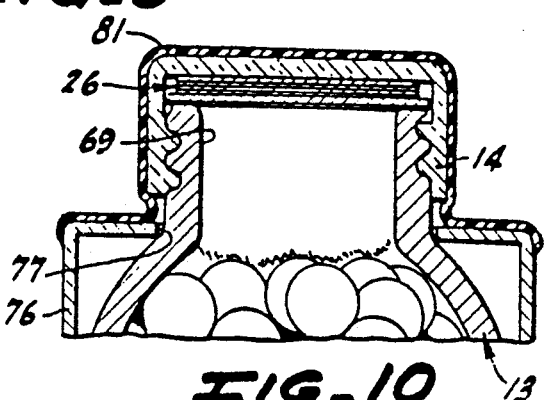
FIG. 10 is a partial cross-sectional view of a container utilizing a tamper evident optical device and also utilizing a shrink wrap fitting.

Another embodiment of consumer type packaging is shown in FIG. 10 and consists of a rectangular cardboard container or package 76 which can be rectangular in cross section and which is provided with an opening 77 in its top side through which the necked portion 13*a* of the bottle 13 can extend. The bottle is provided with a transparent cap 14 of the type hereinbefore described through which the optically variable device 26 positioned therein can be viewed. A shrink wrap 81 of a conventional type also formed of a transparent plastic can be applied to the top of the bottle and to the top of the container 76 to facilitate handling of the package. In such an embodiment it is still possible to view the optically variable 26 through the transparent wrap 81 and also through the transparent cover 14 to see whether or not tampering has occurred with respect to the bottle 13 by viewing the optically variable device 26 to see whether the angle shift properties are present.

It should be appreciated that if desired the coating of the present invention can be applied directly to the shrink material such as the shrink wrap 81 shown in FIG. 10. When such is the case, the shrink wrap can be utilized on a bottle over the cap by placing a suitable adhesive on the bottle and then placing the shrink wrap with the tamper evident film on the same facing the adhesive and shrunk onto the bottle by the use of heat. Thereafter if there is any attempt to remove the shrink wrap, the tamper evident film or coating will split and the color will change from black to silver indicating that an attempt has been made to remove the shrink wrap material from the bottle. The tamper evident coating provided on the shrink wrap makes it impossible for the individual who attempted to remove the shrink wrap to replace the same because the split apart tamper evident coating cannot be reformed.

Figure 11:
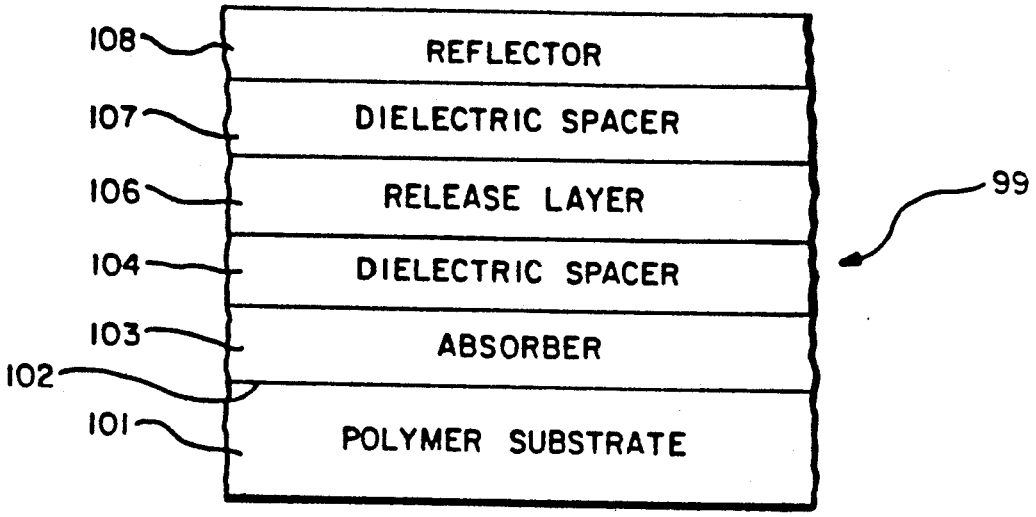
FIG. 11 is a cross-sectional view of another design for a tamper evident optical device incorporating the present invention.
Figure 12:
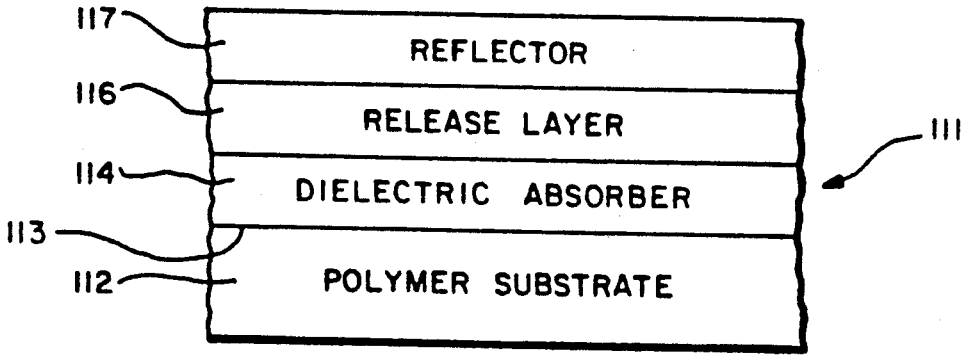
FIG. 12 is a cross-sectional view of still another design for a tamper evident device incorporating the present invention.

Although designs for optically variable optical devices of the type were disclosed and described in connection with FIGS. 4, 5 and 6 it should be appreciated that within the present invention optical tamper evident devices can be provided which utilize other than interference films that change color with viewing angle. Such designs for optical tamper evident devices are shown in FIGS. 11 and 12. As shown in FIG. 11, a polymer substrate 101 is provided which can be formed of a suitable polymer such as a PET or polycarbonate in a thickness ranging from 50 gauge to 700 gauge which corresponds to approximately 0.00050 inches to 0.007 inches. By way of example, the substrate 101 can be formed of PET four mils in thickness corresponding to 0.004 inches. The substrate 101 is provided with a surface 102 on which there is deposited an absorber layer 103 which is formed of a highly absorbing material having an absorption coefficient in excess of 0.05 such as chromium, nickel and Inconel evaporated in a vacuum to a suitable thickness ranging from 30 to 150 Angstroms. Three additional layers 104, 106 and 107 which serve as a combined spacer layer are then evaporated onto the absorber layer 104 in sequence. The combined spacer layer is comprised of two dielectric spacer layers 104 and 107 separated by a release layer 106. The three layers 104, 106 and 107 operate in concert to provide a combination serving as a single spacer layer with a release layer therebetween to provide the desired result. If the color black or a dark mirror is desired, the three layers in combination should have a combined optical thickness of one-quarter wavelength at 350 to 450 nanometers with the dielectric possessing an index of refraction of greater than 1.0. If a color other than black is desired, then the combination of the three layers should have an optical thickness of one-quarter wavelength at 450 nanometers and above using a dielectric of any desired index of refraction. If a device is desired which shifts color with angle in accordance with the designs or embodiments shown in FIGS. 4, 5 and 6, then the three layers in combination should have an optical thickness greater than one-quarter wavelength at 450 nanometers with the dielectric having an index of refraction of 1.9 and below.

By way of example to provide a black color or dark mirror for the optical tamper evident device 99, the dielectric spacers 104 and 107 can be formed of a suitable material such as silicon dioxide having an index of refraction of 1.45 and having individual thicknesses ranging from 100 to 350 Angstroms and preferably approximately 200 Angstroms. The release layer 106 is of the type hereinbefore described in connection with the optically variable devices and as hereinbefore disclosed should have an index of refraction which is close as possible to the index of refraction of the dielectric spacer layers so that it does not affect to a significant degree the optical properties of the optically variable device. As also pointed out the release layer 106 should be formed of a material which permits separation of the optical tamper evident device into two parts. In connection with the present embodiment it has been found that cryolite, $Na_3AlF_6$, is a suitable material which is deposited at a thickness ranging from 20 to 600 Angstroms and preferably to a thickness of approximately 400 Angstroms.

When a single color other than black is desired, the dielectric spacers 104 and 107 are formed of a material having a high index of refraction. Suitable materials are zinc sulfide, cerium stannate and cerium oxide which are deposited to a suitable combined thickness ranging from 690 to 1700 Angstroms. The combined thickness of the layers 104, 106 and 107 is chosen to provide the desired color. In the example where the combined optical thickness for two quarter wavelength or one half wave is at 520 nanometers, a green color is obtained. Similarly at 650 nanometers a magenta color is obtained. Other colors in the spectrum can be obtained by selecting the appropriate optical thickness.

After the layers 104, 106 and 107 have been deposited, a reflector layer 108 is provided. As explained in connection with the previous embodiments, the reflector layer is formed of a material to provide a high reflection and typically which has a silvery appearance. Such a material as previously described is aluminum, however other materials such as nickel, chromium and silver can be utilized if desired. The material should be deposited to a thickness ranging from 400 to 1000 Angstroms and typically for aluminum can have a thickness of 800 Angstroms. It is necessary that the layer have a thickness so that it is opaque to visible light.

In utilizing the optical tamper evident device which is shown in FIG. 11 in connection with the tamper evident packages hereinbefore described, it is apparent that the optical tamper evident device can be utilized in the same manner. Thus, when the combination of three layers utilize a dielectric that has an index of refraction greater than 1.0 and the selected quarterwave optical thickness is between 350 and 450 nanometers, the optical tamper evident device has a black or dark mirror color. When the optical tamper evident device is tampered with, it separates into two parts at the release layer 106. This will cause the color to change from the black appearance to a reflective aluminum or silvery appearance to indicate that tampering has occurred with respect to the package. Once the characteristics of the optical interference device have been destroyed, they cannot be re-established by merely pushing the two parts together. The silvery color will remain and the black or dark mirror coloration will not reappear.

If a material possessing a high index of refraction (for example, above 1.9) is utilized with an optical thickness greater than 450 nanometers, the optical tamper evident device when utilized in a package will have a colored appearance of the chosen color, for example, green or magenta. When separation occurs between the parts at the release layer, the color will change from the selected color to the reflective aluminum or silvery color again to clearly indicate that tampering has occurred with the package. Because of the characteristics of the optical tamper evident device, the color cannot be restored merely by pushing the two parts together.

With respect to the combination of three layers 104, 106 and 107 shown in FIG. 11, it should be appreciated that it is possible to achieve substantially the same effects by combining the thicknesses of the two dielectric spacers 104 and 107 in a single layer on one side or the other of the release layer and having the release layer either in contact with the reflector on one side or in contact with the absorber on the other side. However, it is desirable that the release layer be between two dielectric spacers, rather than as was described above because there is greater assurance that the optical tamper evident device will separate into two parts between the dielectric spacers than there is when the release layer is between the dielectric spacer and the reflector or between the dielectric spacer and the absorber.

Still another embodiment of a tamper evident optical device is shown in FIG. 12 in which the optical tamper evident device 111 is provided with a polymer substrate 112 of the type hereinbefore described in connection with FIG. 11.

The substrate 112 is provided with a surface 113 on which there is deposited a dielectric absorber layer 114. The dielectric absorber layer 114 is formed of a suitable material such as silicon or germanium which has an absorption coefficient of greater than 0.05 in the visible spectrum and is deposited to a thickness ranging from 500 to 1600 Angstroms. The thickness of this layer is chosen to provide desired color. As, for example, at 500 Angstroms the color blue is provided, whereas at 800 Angstroms the color magenta is provided. The release layer 116 is then deposited on the dielectric absorber 114 and can be formed of a suitable material such as cryolite or Teflon to a thickness ranging from 20 to 600 Angstroms and preferably a thickness of approximately 60 Angstroms for Teflon and 400 Angstroms for cryolite. A reflector layer 117 is deposited on the release layer 116 of a suitable material of the type hereinbefore described as, for example, aluminum to a thickness ranging from 400 to 1000 Angstroms and preferably a thickness of approximately 800 Angstroms. As pointed out above, it is necessary that the reflector layer 117 be opaque to visible light.

The optical tamper evident device 111 shown in FIG. 12 provides a selected color which will not shift with angle. When it is utilized in packaging, it will have the selected color and when tampering has occurred, the selected color will disappear and the reflected aluminum or silvery color will appear to clearly indicate that tampering has occurred. The optical tamper evident device 111 shown in FIG. 12 has an advantage over the tamper evident optical device shown in FIG. 11 in that it is comprised of fewer layers.

Figure 13:
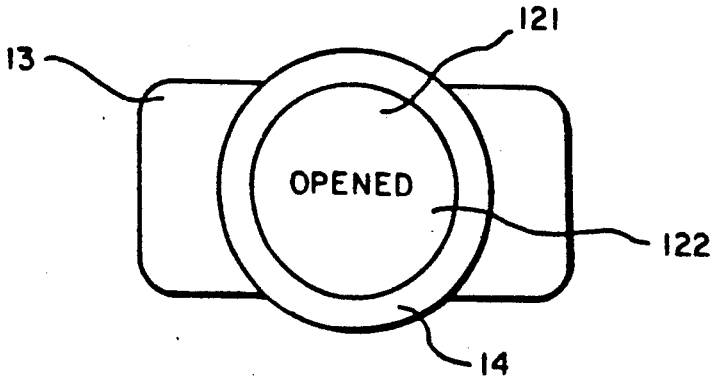
FIG. 13 is a plan view of a warning imprint that can be incorporated into the tamper evident optical device.

In connection with the optical tamper evident device of the present invention, it should be appreciated that the optical devices can be imprinted with an appropriate message as, for example "OPENED" as shown in FIG. 13.

Thus an optical tamper evident device 121 can be provided in which an imprinting 122 has been printed onto the polymer substrate 101 in FIG. 11 or 112 in FIG. 12 by imprinting it on either of the two surfaces provided on the polymer substrate. This imprinting can be in a black or can be in a selected colored ink if desired. For example, if the color selected matches the color of the interference stack, the imprinted message will only be apparent after tampering has occurred. A clear ink may be employed in this fashion as well. Using a clear ink with low adhesion selectively prevents the destruction of the device which results in the pattern remaining where the ink is present. Thus, a message imprinted with a clear ink would only become visible after tampering occurs. Alternatively, a patterned adhesive could be used at surfaces 102 or 113 to selectively destroy the interference property of the film upon the occurrence of tampering thus exposing the message by the selective destruction of the device. In FIG. 13, the optical tamper evident device 121 has been incorporated into the cap 14 of the bottle 13 shown in FIGS. 7, 8 and 9.

Figure 14:
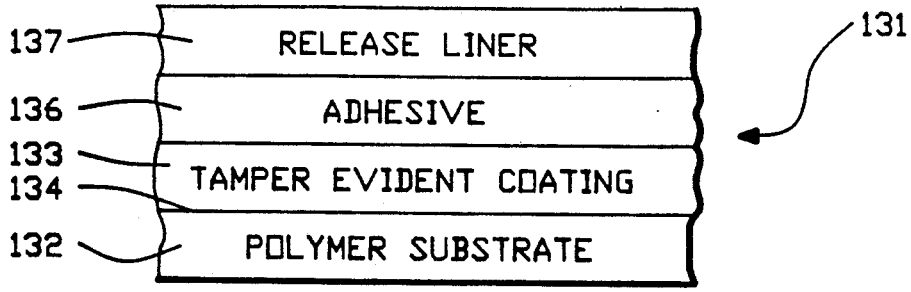
FIG. 14 is a cross sectional view of another design of a tamper evident optical device incorporating the present invention in the form of a tape.

Still another embodiment of the invention is shown in FIG. 14 in which there is provided a tamper evident tape 131. This tape is comprised of a flexible substrate of a suitable material such as PET which is a polymer substrate of the type hereinbefore described. A tamper evident coating 133 of the type hereinbefore described is placed on one surface 134 of the substrate 132. A pressure sensitive adhesive 136 is placed on the tamper evident coating 133. A release liner 137 of a suitable type as, for example, a paper release liner is placed on the pressure sensitive adhesive 136. When the release liner 137 is removed, there is present a tacky surface on the adhesive layer 136 which makes it possible to attach the tamper evident tape 131 to an article.

The article on which the pressure sensitive tape 131 can be used can be of various types. For example, it can be a cardboard or fiberboard container which has a lid and a bottom and in which it is desired to detect whether or not an authorized entry has been made. In such an application, the tamper evident tape 131 can be utilized by removing the release liner 137 from the tape 131 and securing the tape to the lid and bottom in the areas where entry may occur by placing the tacky adhesive surface against the container. Similarly, it can be utilized on partitions or a wall or any other article where it is wished to be advised of any unauthorized entry. When there is any attempt to remove the tape, the tape will cause separation or splitting of the tamper evident coating 133 in the manner hereinbefore described and the color will turn from black to silver or grey. If any attempt is made to replace the tape, the color will still remain grey because of the incapability of restoring the tamper evident coating 133 to its original state indicating that tampering had occurred with respect to the article carrying tamper evident tape.

As explained previously by patterning the adhesive 136 it is possible to provide a tape which can also give a message such as that tampering has occurred. The black color would turn to silver with a black message. The message as explained previously could be in the form of the word "opened".

Figure 15:
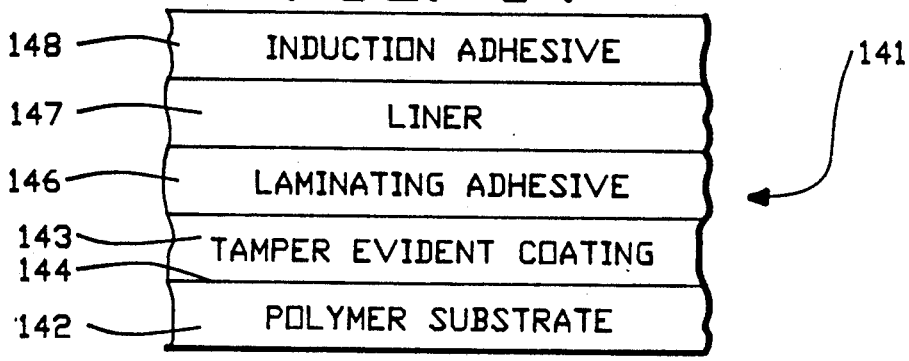
FIG. 15 is a cross sectional view of still another design of a tamper evident device incorporating the present invention in which is incorporated for use as a cap liner material.

In FIG. 15 there is shown another embodiment of the invention which is in the form of a tamper evident liner material 141 that consists of a flexible polymer substrate 142 of the type hereinbefore described upon which a tamper evident coating 143 is deposited on a surface 144. A laminating adhesive 146 of a conventional type, such as SpeedBond TM, a water based acrylic sold by Horton Chemical, having a thickness ranging from 2 mils to 0.3 mils and preferably a thickness of 1 mil is provided on the coating 143. A liner 147 is secured to the laminated adhesive 146 and is also of a conventional type. An induction adhesive layer 148 is carried by the liner 147.

As explained, the liner 147 is a commercially available material which is used as a liner in bottle caps. Typically such a liner comprises at least a layer of aluminum foil. In certain applications the liner can take the form of a layer of aluminum foil with a resilient backing in the form of a wad. Such a wad typically can be formed of a cellulose fiber material or polyethylene foam and can have a thickness ranging from 0.010 to 0.030 inches. The aluminum foil can have a thickness ranging from 0.001 to 0.200 inches. The induction adhesive layer 142 is formed of a thermosetting adhesive also of a conventional type which is not tacky at room temperature so that the tamper evident liner 141 can be readily handled. The thermosetting adhesive is of a type which can be bonded by the use of radiofrequency energy.

In manufacturing the tamper evident liner material 141 shown in FIG. 1, the desired liner material 147 can be purchased from a commercial source. The induction adhesive layer 142 is then applied to one side of the liner material.

In a separate operation, the polymer substrate 142 can be provided with the tamper evident coating 143 and thereafter, a laminating adhesive 146 can be either be applied to the coating 143 or alternatively it can be applied to the other side of the liner 147 opposite the induction adhesive layer 148. Thereafter, the two sheet materials, one comprising the liner 147 with the induction adhesive 148 carried thereby and the other sheet material comprising the polymer substrate 142 with the tamper evident coating 143 thereon and with the laminating adhesive layer 146 either on the liner 147 or on the coating 143 can be laminated into a single sheet 141 together by passing the two sheet materials through nip rollers (not shown) in which one of the rollers is heated to soften or melt the adhesive 146 to form a bond between the coating 143 and the liner 147 by the use of the laminated adhesive 146. Thereafter, the laminated sheet material 141 can be slit or cut in a desired width or length and wound onto spools. The ribbons of laminated liner material 141 may then be die cut into any appropriate size or shape to fit into existing cap lining machinery for installation into caps. Typically the cap liner material is inserted into the cap so that the polymer substrate 142 faces upwardly into the cap with the induction adhesive layer 140 facing downwardly. The cap is threaded or fitted onto the bottle which typically can be formed of a polyethylene with the induction adhesive layer 148 coming into contact with the top of the neck of the bottle. Radiofrequency energy is then applied to the bottle cap which causes softening of the induction adhesive layer 148 and causes a bond to be formed between the bottle and the liner material 141. The cap may be opaque thus hiding the tamper evident liner 141.

When the cap of the bottle is removed, the liner material 141 remains secured to the bottle top but prevents access to the bottle as, for example, poking the finger through the liner material 141 until the polymer film 142 has been removed. Thus this tamper evident device or liner 141 can be considered to be a "free" device because it is free of the cap. As soon as the polymer film 142 is removed, the tamper evident coating 143 is separated to cause a color shift to occur of the type hereinbefore described as, for example, by turning from black to silver. The black color cannot be restored for reasons hereinbefore described and thus, the silver color or lack of a black color gives a permanent indication that access to the bottle had been attempted and/or that tampering had occurred.

If it is desired that a message be imprinted in the liner material 141 or alternatively, a pattern appear in the liner material 141 this can be accomplished in a number of different ways. For example, a pattern such as words or a logo can be imprinted on the polymer substrate 142 and then the tamper evident coating 143 is applied over the printing to conceal the imprinted pattern so that it would not be readily discernable by the human eye. If desired, the imprinting can be in the form of a color. When this is the case, the tamper evident coating 143 is appropriately color matched so that the pattern would not be readily discernable. Thus it can be seen that if such a liner material is utilized as a bottle liner, when opening occurs and the tamper evident coating 143 is split apart, the previously imprinted message will be readily visible on the polymer substrate 142.

Alternatively, the laminating adhesive layer 146 can be applied in a pattern such as words or a logo to a nonimprinted tamper evident film comprised of the polymer substrate 142 and the tamper evident coating 143. When the tamper evident film is laminated to the liner 147 carrying the inductive adhesive layer 148 under heat and pressure in the nip rolls the message carried by the laminated adhesive 146 will be concealed and will not be visible through the black surface of the tamper evident coating 143. When the polymer substrate 142 is removed, the tamper evident coating 143 will be split apart in the manner in which it replicates the pattern in the adhesive. The result will be a pattern or message which will be silver in color wherever the adhesive was present and will be black in other areas to give the desired message as, for example, to show that the bottle had been opened or had been tampered with. If the exposed surface of the liner 147 is colored before the application of the patterned laminated adhesive, then when the tamper evident device formed by the coating 143 is activated and the polymer substrate 142 is removed, a message will be presented which is a replication of the patterned adhesive which will be silver wherever the adhesive was applied and will be the color of the color on the liner 147 wherever the adhesive was not applied. For example, if the liner 147 is colored red, then the tamper evident thin film when split will provide a message or logo on the liner 147 which matches the message or logo of the laminating adhesive and thus the message would be seen against a silver background. Alternatively, a negative image could be produced simply by applying the adhesive in the areas of the message In this case, one would see a silver message on a red background.

It should be appreciated that if desired, the tamper evident liner 141 can be constructed so that it will adhere to the cap and thus not be a "free" device, but rather a "captured" device in which it remains with the cap. In such an arrangement, the tamper evident liner 141 is adherent both to the cap and the bottle top. In such an application, the cap could be opaque with a hole or window in its top through which a tamper evident liner 141 could be observed as with the tamper evident devices hereinbefore disclosed. The steps of construction and assembly basically would be the same as hereinbefore described with respect to the "free" tamper evident liner with the exception that a clear adhesive would be placed inside the cap, or alternatively, on the polymer substrate 142 before the liner 141 is inserted into the cap with the substrate 142 facing into the cap. The clear adhesive will secure the substrate 142 to the cap. By the use of radio frequency energy hereinbefore described, the induction adhesive is heated to form a bond between the tamper evident liner 141 and the top of the bottle. The liner 141 will have the conventional color, as for example, the black color as in the previous embodiments. However, when the cap is removed, the tamper evident coating 143 will be separated or split into two parts to cause a color change, as for example, from black to silver. If a message or logo is incorporated in the tamper evident liner 141, this message or logo will also become visible through the top of the cap.

In the previous embodiments when a printed message is provided when the tamper evident device is opened, the message will appear against a silver background. This has several desirable features It has the highest contrast for the human eye so that the printed message can be seen under low light conditions. In addition with the printed message, the message itself is self-educational. There is no necessity to educate the user to learn which color indicates that tampering has occurred. In addition by utilizing such printed instructions, it is possible for color blind people to also view the tamper evident device to ascertain whether or not tampering has occurred.

In order to provide the construction of the tamper evident coating 143, it is possible to start with a prealuminized polyester in which the polyester can serve as a substrate and the aluminum coating serves as the first layer of the tamper evident thin film tamper evident coating. With such a material, it is only necessary to add a layer of wax or other release material which is then followed by a dielectric spacer layer and a metal absorber layer in accordance with the present invention.

Figure 16:
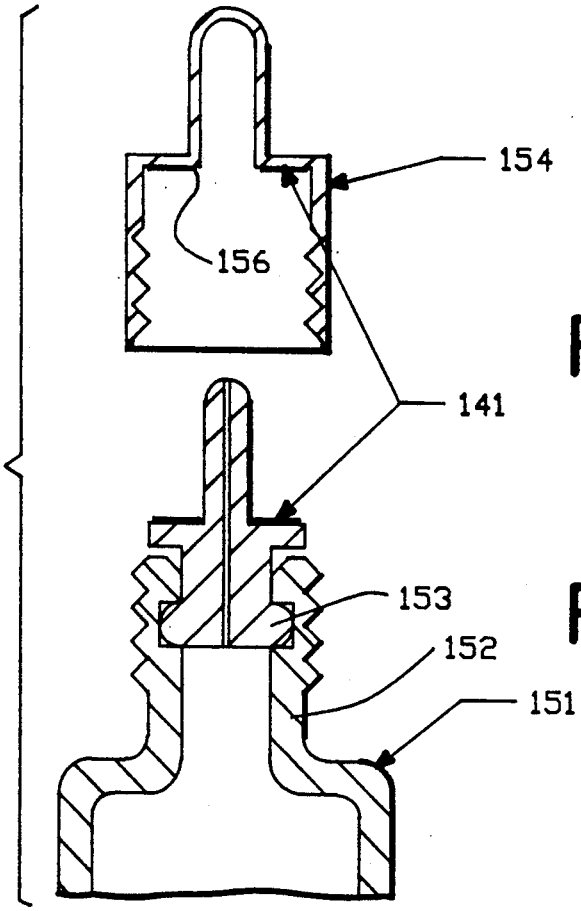
FIG. 16 is a cross sectional view of a container and cap having a tamper evident liner incorporated therein and showing the cap removed from the bottle.
Figure 16A:
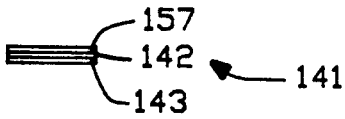
FIG. 16A and 16B show the tamper evident liner.
Figure 16B:
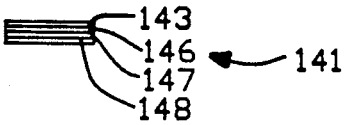

It should be appreciated that the tamper evident device of the present invention can be utilized with the containers other than caps closing a bottle. For example, as shown in FIG. 16 it can be utilized with a container in the form of a bottle 151 having a neck 152 which has a dispensing nozzle 153 of a conventional type mounted therein. The dispensing nozzle 153 can be enclosed by a bottle cap 154 which is threaded onto the bottle neck 152 and which serves to enclose the dispensing nozzle 153 when it is not in use.

The tamper evident liner of the present invention can be utilized with such a bottle 151 and bottle cap 152 by forming the liner 141 as an annulus or ring which has an opening 156 and to accommodate the dispensing nozzle 153. The cap 154 is preferably formed of a transparent material or alternatively, at least the portion of the cap overlying the tamper evident device should be transparent so that it can be viewed. The tamper evident device is mounted between the cap and the neck 152 of the container 151 so that it is adhered to both the neck and the cap. This can be readily accomplished by placing an adhesive layer on the substrate 152 to cause adherence to the cap 154 and then utilizing radiofrequency heating to bond the induction adhesive 148 to the top or neck of the bottle 152.

When the bottle cap 154 is in place, one viewing the bottle would see a ring of color, as for example, black from the ring of tamper evident device 141. When the cap is opened, the color black would change to a solid silver color or a contrasting message in silver against a colored background or a colored message against a silver background if other embodiments of the tamper evident device 141 are utilized of the type hereinbefore described. In the position of the cap 154 as shown in FIG. 16, the tamper evident device has been separated and split into two parts by splitting the tamper evident coating 133. Thus the tamper evident device 141 as viewed from the bottle cap 154 after the cap has been removed would be silver in color.

Figure 17:
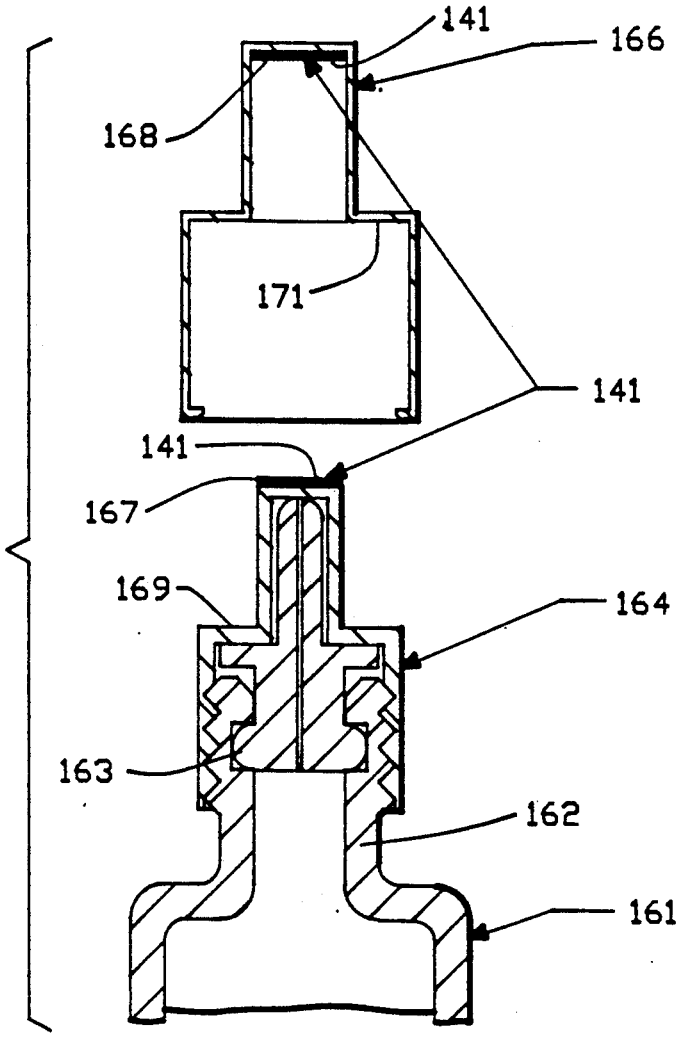
FIG. 17 is a cross sectional view of a bottle with the primary cap in a protective cap and in which the tamper evident liner is incorporated between the primary cap and the protective cap and showing the protective cap removed.

It should be appreciated that an arrangement similar to that shown in FIG. 16 can be utilized for placing a disposable protective cover or cap over an existing cap of a bottle or container as shown in FIG. 17. Thus a bottle 161 having a neck 162 is provided which has a nozzle 163 mounted therein. A primary cap 164 is secured to the neck 162. A protective cap 166 is snapped onto the primary cap 164. A tamper evident liner 141 is adherent to a surface 167 on the primary cap 164 and a surface 168 inside the protective cap 166. Alternatively, the tamper evident liner 141 can be formed as an annulus adherent to the surfaces 169 and 171 of the caps 164 and 166. A similar concept could be utilized in which the protective cap or at least a portion thereof would be transparent to permit viewing of a tamper evident liner material incorporated between the protective cap and the cover. Thus when the protective cap is removed, a color shift will occur from black to silver again indicating that tampering has occurred.

Thus it can be seen that the tamper evident liner 141 can be utilized in a number of different ways. It is merely necessary that it be placed in a position between the bottle and the cap or between a cap of the bottle and another protective cap which must be removed to obtain access to the bottle or the container. The tamper evident liner should be positioned in a location between the protective cap and the primary or main cap enclosing the bottle in such a manner so that when the protective cap is removed, the liner material will be split to cause the color shift hereinbefore indicated.

Figure 18:
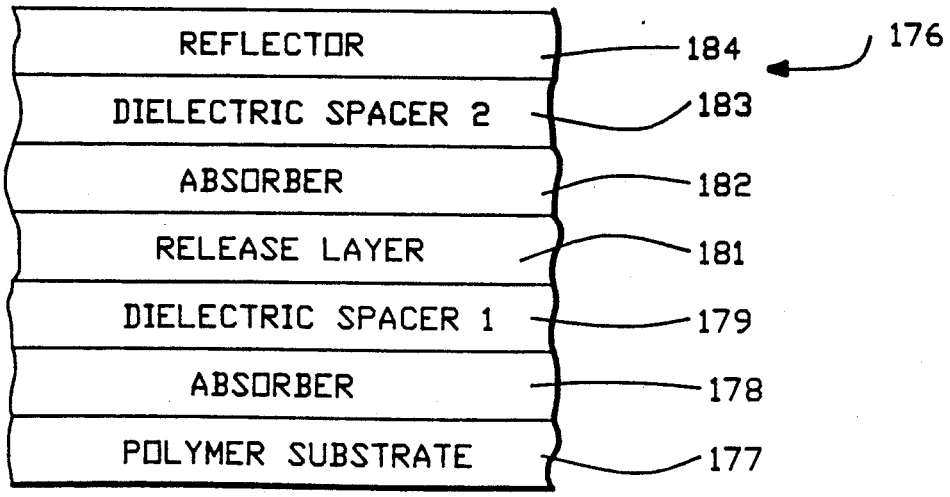
FIG. 18 is a cross sectional view of another design of a tamper evident optical device of the above character which provides two colors.

Another tamper evident liner 176 is shown in FIG. 18 and utilizes a two color splittable coating which gives one color when the coating has not been disturbed and which gives a different color when the coating is split into two parts. As shown in FIG. 18, this tamper evident device consists of a polymer substrate 177 of the type hereinbefore described that is coated with an absorber layer 178 which by way of example, can be formed of PET having a thickness from 1½ to 7 mils, followed by a metal absorber formed of a suitable material, as for example, 40 to 90 Angstroms of chromium. This is followed by a dielectric spacer layer 179 which by way of example can be formed of magnesium fluoride to a halfwave optical thickness of 400 to 500 nanometers. This is followed by a release layer 141 formed of Teflon or a wax material having a thickness ranging from 20 to 100 Angstroms. On top of the release layer there is provided another absorber layer 182 which again can be formed of chromium of the same thickness as the absorber layer 178. Another dielectric spacer layer 183 is provided on the absorber layer 182. Typically this dielectric spacer layer 183 Would have a thickness which is different from the thickness of the first dielectric spacer layer 179. For example, it could be formed of magnesium fluoride having a halfwave optical thickness of 600 nanometers. Finally a reflective layer 184 of a suitable material which is highly reflective, such as aluminum or silver is provided.

This tamper evident liner 176 shown in FIG. 18 would be utilized in the same manner as hereinbefore described when a very distinct color other than black is desired. When the device 176 is disturbed, as for example, when it has been separated into two parts it would have a different distinct color. When the device 176 is separated, one piece would be comprised of the polymer absorber 178 and the dielectric spacer 179 whereas the other piece would be comprised of the absorber 182, the dielectric spacer 183 and the reflector 184. The one piece would have very little color except for possibly gray in transmission. The second piece of the absorber dielectric and reflector would have a second distinct color. Viewing through the polymer substrate before separation gives one distinct color and viewing the second or other piece after separation gives the viewer another distinct color, the color of the absorber dielectric and reflector stack.

The use of such a color tamper evident device has several advantages. In addition, to indicating that tampering had occurred, it also could serve as an anticounterfeiting device. If the appropriate color shift is not obtained, it would indicate that the article being opened is counterfeit. The color of the entire tamper evident device 176 is dictated by the thickness of the two dielectric spacers 179 and 83. On the other hand, the color after splitting would only be affected by the dielectric spacer 183 near the reflector 184.

It should be appreciated that if desired, messages can be incorporated in the tamper evident liner 176 in the same manner as hereinbefore described.

Figure 19:
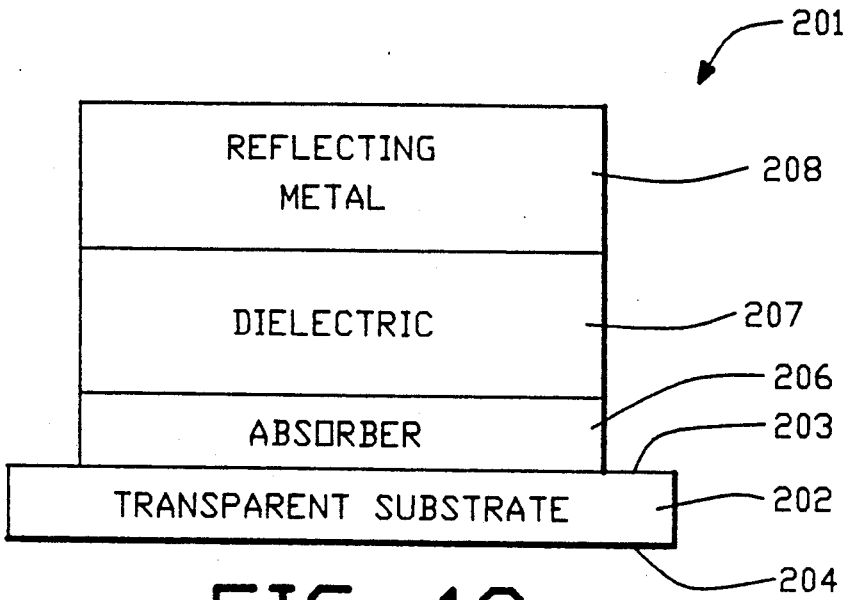
FIG. 19 is a cross sectional view of a tamper evident optical device of the above character which is easy to manufacture.

Still another embodiment of the present invention is shown in FIG. 19 in which the tamper evident device is easy to manufacture, that is, it can be manufactured without breaking the vacuum during deposition of the various layers. As shown in FIG. 19, the optical device 201 is comprised of a transparent substrate 202 formed of a plastic material of the type hereinbefore described which is provided with surfaces 203 and 204. A metal absorber layer 206 is deposited on the surface 203 and can be formed of any of the grey metals hereinbefore described. It can have a thickness ranging from 30 to 75 Angstroms and preferably a thickness of approximately 65 Angstroms. A dielectric layer 207 is deposited on the metal absorber layer 206 and is formed of a suitable dielectric such as magnesium fluoride or silicon dioxide. Its thickness is dependent upon the color desired for the tamper evident device. For example, it can have a thickness ranging from 3 to 7 quarterwaves at a design wavelength between 400 and 700 nanometers. A reflecting metal layer 208 is deposited on the dielectric layer 207 and is formed of a suitable material such as silver or a silver palladium alloy. The palladium content of the silver palladium alloy can range from 0 to 25% palladium with respect to silver by weight, although a 3% by weight of palladium is preferable. The silver or silver palladium alloy can have a thickness ranging from 800 to 1600 Angstroms. The layers 206, 207 and 208 form a coating on the surface and incorporate a release region to permit splitting of the coating.

The device shown in FIG. 19 has a silver appearance from the silver side. From the polyester or substrate side, it has a black or colored appearance depending upon the thickness of the dielectric layer 207. After the device has been split apart, as when tampering has occurred, the silver side would still have a silver appearance. However, the polyester or substrate side would transmit a grayish color and thus would look neutral in transmission.

It should be appreciated that the design of the device shown in FIG. 19 can be reversed if desired. Thus, the silver or silver palladium alloy layer could be deposited on the surface 213 followed by the dielectric layer 207 and thereafter, the metal layer 206. In such a device from the substrate side, the device would have a silver appearance whereas on the other side it would have a black or colored appearance depending on the thickness of the dielectric before splitting and after splitting, it would have a neutral gray appearance.

In both of the designs, the release region for the device is formed by providing within the design a region of poor adhesion between two layers rather than providing a separate release layer as in the hereinbefore described designs. The region of poor adhesion occurs between the silver or silver palladium alloy and the dielectric and thus splitting occurs in these designs between those layers.

Figure 20:
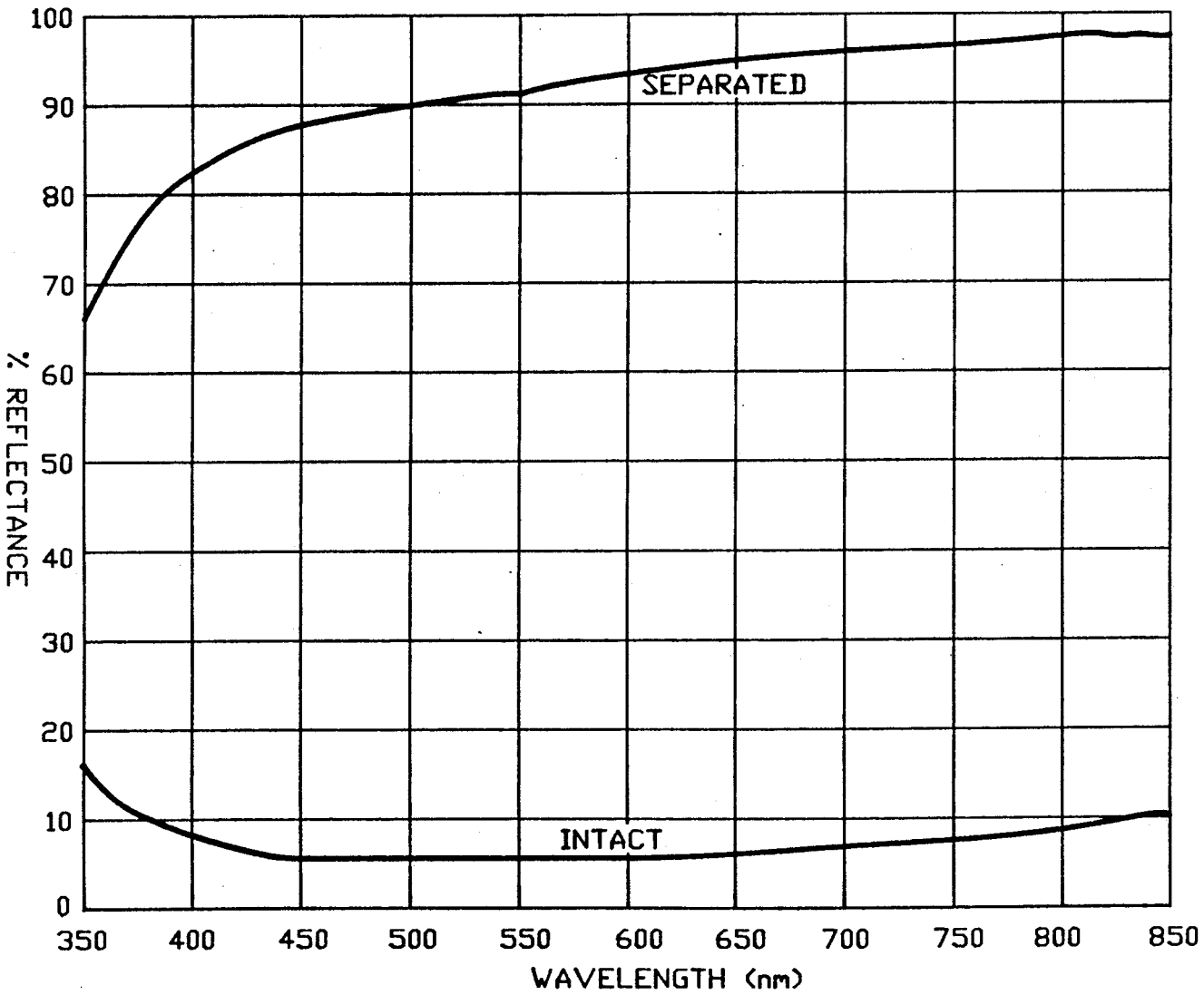
FIG. 20 is a graph showing reflectance versus wavelength as viewed through a polyester substrate of the device shown in FIG. 19 before and after separation of the device.

A graph is shown in FIG. 20 of the device shown in FIG. 19 and shows two curves, one curve labeled "intact" at the bottom of the graph and the other curve labeled "separated" at the top of the graph which shows the percent of reflectance from 350 to 850 nanometers. The design shown in FIG. 20 is a black design rather than a colored design and shows a relatively low reflectance below 10% when the device is intact whereas when the device is separated and has the neutral gray transmission color, the reflectance is relatively high as for example, above 80% above 400 nanometers and above 90% beyond 500 nanometers in wavelength. Once the device has been separated, the design cannot be rejoined to reflect the original black or, for example, if the dielectric layer 207 is of a thickness to provide a color, the color cannot be restored, thus, giving evidence that tampering has occurred.

The design shown in FIG. 19 is advantageous because it is relatively easy to manufacture. It can be made in one vacuum. It does not require multiple vacuums of the earlier designs disclosed herein. The design of the present invention can be made in a conventional roll coater in which the substrate in the form of a flexible plastic film travels over two rollers and in which a reflecting metal layer or the metal absorber layer can be deposited at the one roller depending on which metal surface is to be viewed from the side opposite the substrate and the dielectric, such as magnesium fluoride or silicon dioxide can be deposited at the other roller. These two materials can be deposited in one pass of the web or film. The third material which can be either the chromium or the silver or silver palladium alloy can be deposited in the return pass of the web or film. Typically the chromium can be deposited at one drum, the dielectric at the other drum in one pass from the supply roll to the takeup roll and then the silver palladium alloy sputtered onto the web in the return pass from the takeup roll to the supply roll to provide the three layer coating. With such an arrangement it can be seen that all three layers can be deposited in a roll coater without breaking the vacuum merely by having the web travel through two passes in the coater.

Figure 21A:
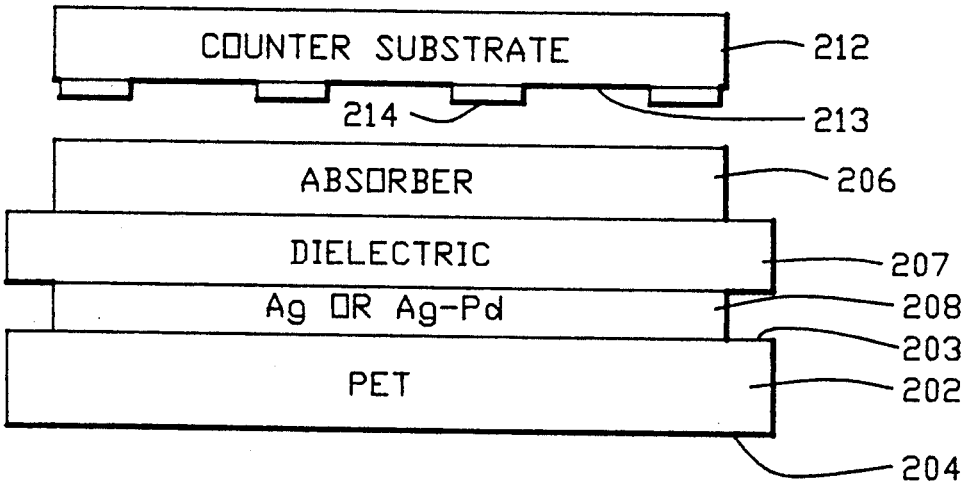
FIG. 21A is a cross sectional view of a tamper evident device of the type shown in FIG. 19 but with the layers being reversed as hereinbefore described and showing the same being utilized with a counter substrate carrying a printed adhesive.
Figure 21B:
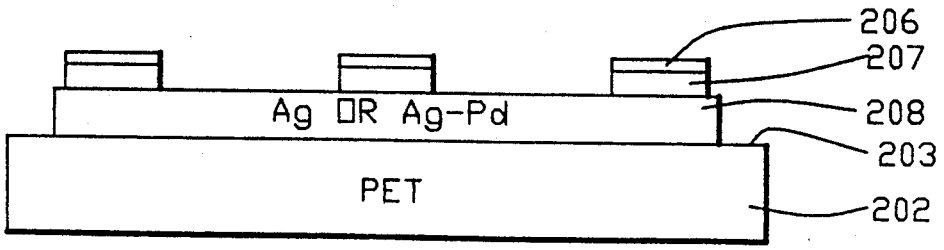
FIG. 21B is a cross sectional view showing the optical device in FIG. 21A after the counter substrate carrying the printed adhesive has been removed to provide a message which is black or colored on a silver background after the splitting has occurred.

Another embodiment of the tamper evident device of the present invention is shown in FIGS. 21A and 21B. As shown in FIG. 21A, the device 211 is of the design shown in FIG. 19 with the exception that the silver or the silver palladium layer 208 is placed on the surface 203, and thus the chrome layer 206 is disposed on the outside layer on the device rather than the silver or silver palladium layer as shown in FIG. 19. Another film or web which serves as a substrate 212 is provided formed of a suitable plastic of the type hereinbefore described having a surface 213 on which there has been provided an adhesive 214 which can be deposited thereon in a suitable manner such as by printing to form a pattern thereon as, for example, to give a printed message as, for example, "Opened". The web or film serving as the substrate 212 carrying the adhesive 214 is brought into engagement with the chrome layer 206 to provide the structure or device 211. The web or film then can be cut up in an appropriate manner so that the devices can be utilized in bottle caps, packages and the like as hereinbefore described.

When a bottle or container is opened which has the tamper evident device of the present invention incorporated therein, and when that bottle or container is opened, the separation occurs only where the adhesive 214 is present. As shown in FIG. 21B this leaves a black message as, for example, the word "OPENED" with a silver background to indicate that the container or bottle has been opened.

From the foregoing it can be seen that there has been provided a tamper evident optical interference device which can be utilized in connection with various types of articles such as containers for packaging various products and particularly consumer type products. The optical tamper optical device can also be used on customs seals, classified document seals and the like. The tamper evident optical device can be readily incorporated into conventional type packaging utilized on consumer products. The tamper evident optical device has such characteristics that the public can be readily educated to ascertain whether or not tampering has occurred with respect to the container or package carrying the product. The consumer at the point of sale can readily ascertain whether tampering has occurred by viewing the optically variable device. If the optical tamper evident device is without color when viewed at different angles, the consumer will know that tampering has occurred and can bring this to the attention of the retailer distributing the product, or alternatively, the customer will see the printed word such as "OPENED" against a reflective background and would know that tampering has occurred.

What is claimed is:

1. In a tamper evident optical device, a substrate, a multi-layer tamper evident splittable coating carried by the substrate, said coating having a release region formed therein and adhesive means secured to said tamper evident coating, said adhesive means including means permitting said device to be handled without adhering to other substances the device may come into contact with.

2. A device as in claim 1 wherein said release region is formed by a separate release layer.

3. A device as in claim 1 wherein said release layer is formed by a region of poor adhesion between two adjacent layers of the coating.

4. A device as in claim 1 in the form of flexible tape wherein said adhesive means includes an adhesive layer and a removable release liner adhered to the adhesive layer.

5. A device as in claim 1 wherein said adhesive means comprises a laminating adhesive secured to the tamper evident splittable coating, a liner secured to the laminating adhesive, said liner having a metal layer incorporated therein, and an induction adhesive layer adherent to said liner, said induction adhesive layer being relatively solid and stable at room temperature and being capable of being softened by the introduction of radio-frequency energy into the metal layer of the liner to create heat for softening of the induction adhesive layer.

6. A device as in claim 1 wherein a message is incorporated in the device by imprinting the message on the substrate.

7. A device as in claim 1 wherein a message is incorporated in the device by providing a pattern in the adhesive.

8. A device as in claim 1 wherein said tamper evident coating is comprised of first and second dielectric spacers to provide a shift from one color to another color when the tamper evident coating is split apart.

9. A device as in claim 3, wherein said multi-layer tamper evident splittable coating is comprised only of three layers in the form of two metal layers separated by a dielectric layer and in which one of the metal layers is an absorber layer and in which the other of the metal layers is a reflecting layer.

10. A device as in claim 9, wherein said reflecting layer is formed of silver or a silver, palladium alloy.

11. A device as in claim 10, wherein said silver palladium alloy has from 3 to 5% by weight of palladium to silver.

12. A device as in claim 9 wherein the region of poor adhesion occurs between the dielectric and the silver or silver palladium alloy.

13. A device as in claim 9 wherein said reflective layer is adjacent the substrate.

14. A device as in claim 9 wherein said reflective layer is spaced away from the substrate.

15. A device as in claim 1 together with a counter substrate, adhesive means secured be the counter substrate and having a pattern incorporated therein, the adhesive means being adherent to the metal layer facing away from the substrate.

16. In a tamper evident article, first and second parts which are movable with respect to each other, a tamper evident optical device disposed between said first and second parts and being adherent to at least one of said first and second parts, the tamper evident optical device displaying a desired optical property, the tamper evident optical device having a substrate, a splittable tamper evident coating adherent to the substrate, a liner having a metal layer incorporated therein, adhesive means securing the liner to the tamper evident coating and an induction adhesive secured to the liner, said induction adhesive being bonded to said one part.

17. An article as in claim 16 together with an adhesive bonding said substrate to said other part.

18. An article as in claim 16 wherein said first part is in the form of a container and wherein said second part is in the form of a cap enclosing said container.

19. An article as in claim 18 wherein the container is in the form of a bottle having a rim surrounding an opening wherein said cap: is of a type which is adapted to be secured to the neck of the bottle, said tamper evident optical device being disposed between the cap and the rim of the bottle and being adherent at least to the rim of the bottle.

20. An article as in claim 18 wherein said container has been provided with a protrusion which extends upwardly from the container and wherein said cap is formed to receive the upwardly extending protrusion and wherein the tamper evident optical device is formed so that it surrounds the protrusion, at least a portion of the cap being visible to permit viewing of the tamper evident optical device.

21. An article as in claim 19 together with an adhesive for securing the device to the cap.

22. An article as in claim 16 wherein the article is in the form of a container having a first cap and a second cap removably mounted on the first cap and wherein the tamper evident device is disposed between the first and second caps and is adherent to the first and second caps.

23. An article as in claim 16 wherein said splittable tamper evident coating has incorporated therein a release region.

24. An article as in claim 23 wherein said coating is a multi-layer coating and wherein said release region is formed by a region of poor adhesion between two adjacent layers in the coating.

25. An article as in claim 23 wherein said release region is formed by a release layer incorporated into the coating.

* * * * *